US008047254B2

(12) United States Patent
Bolton, III

(10) Patent No.: US 8,047,254 B2
(45) Date of Patent: Nov. 1, 2011

(54) MAGNETIC CORDLESS SHADE

(76) Inventor: Robert E. Bolton, III, Joliet, IL (US)

( * ) Notice: Subject to any disclaimer, the term of this patent is extended or adjusted under 35 U.S.C. 154(b) by 125 days.

(21) Appl. No.: 12/457,294

(22) Filed: Jun. 5, 2009

(65) Prior Publication Data

US 2010/0307696 A1 Dec. 9, 2010

(51) Int. Cl.
*A47H 5/00* (2006.01)

(52) U.S. Cl. ..... 160/84.04; 160/168.1 R; 160/178.1 R; 160/34

(58) Field of Classification Search ..... 160/34, 160/84.01–84.06, 168.1 R, 170, 171, 178.1 R, 160/DIG. 16
See application file for complete search history.

(56) References Cited

U.S. PATENT DOCUMENTS

| | | | | |
|---|---|---|---|---|
| 2,370,794 | A * | 3/1945 | Houmere | 160/113 |
| 3,104,700 | A * | 9/1963 | Polsky | 160/298 |
| 4,062,483 | A | 12/1977 | Brigante | |
| 4,079,772 | A | 3/1978 | Klaenhammer et al. | |
| 4,397,346 | A * | 8/1983 | Chumbley et al. | 160/84.01 |
| 4,733,711 | A * | 3/1988 | Schon | 160/84.03 |
| 4,776,381 | A * | 10/1988 | Riddiford | 160/172 R |
| 4,802,523 | A * | 2/1989 | Scholten et al. | 160/354 |
| 5,158,127 | A * | 10/1992 | Schumacher | 160/84.07 |
| 5,170,830 | A * | 12/1992 | Coslett | 160/84.04 |
| 5,396,944 | A * | 3/1995 | Rossini | 160/107 |
| 5,495,883 | A * | 3/1996 | Jelic | 160/84.04 |
| 5,769,142 | A | 6/1998 | Nicolosi | |
| 6,095,223 | A | 8/2000 | Rossini et al. | |
| 6,283,518 | B1 * | 9/2001 | Burtin | 293/142 |
| 6,463,985 | B1 * | 10/2002 | Hsu | 160/84.04 |
| 6,968,885 | B2 * | 11/2005 | Nien | 160/172 R |
| 7,000,670 | B2 * | 2/2006 | Kwon et al. | 160/107 |
| 7,111,659 | B2 * | 9/2006 | Harper et al. | 160/84.05 |
| 7,114,545 | B2 | 10/2006 | Null | |
| 7,117,918 | B2 * | 10/2006 | Franssen | 160/84.06 |
| 7,124,803 | B2 * | 10/2006 | Jin et al. | 160/107 |
| 7,174,944 | B1 * | 2/2007 | Clark et al. | 160/197 |
| 7,180,665 | B2 * | 2/2007 | Daniel et al. | 359/461 |
| 7,225,850 | B2 * | 6/2007 | McCarty et al. | 160/168.1 R |

(Continued)

FOREIGN PATENT DOCUMENTS

DE 2921608 12/1980

OTHER PUBLICATIONS

Magneblind Magnetic Mini Blinds, http://www.improvementscatalog.com/home/improvements/792923031-magneblind-magnetic-mini-blinds.html , 2 pages printed from the Internet on Oct. 23, 2008.

*Primary Examiner* — Katherine Mitchell
*Assistant Examiner* — Marcus Menezes
(74) *Attorney, Agent, or Firm* — Richard C. Litman

(57) ABSTRACT

The magnetic cordless shade includes a header defined by a substantially elongated U-shaped channel. The top of the header includes attachment areas for attaching the header to a window frame. A pleated blind has one end attached to the underside of the header top, and when folded, the blind is housed inside the channel. The other end of the pleated blind is attached to a footer. A magnetic latching assembly is disposed between the header and the footer to keep the blind in a folded condition. Pulling a pull cord disposed on the footer releases the magnetic latching mechanism to thereby rapidly unfold the blind.

1 Claim, 5 Drawing Sheets

U.S. PATENT DOCUMENTS

| | | | | |
|---|---|---|---|---|
| 7,299,850 | B2 * | 11/2007 | Miller | 160/133 |
| 7,549,455 | B2 * | 6/2009 | Harper et al. | 160/121.1 |
| 7,669,633 | B2 * | 3/2010 | Berger | 160/107 |
| 2003/0127200 | A1 | 7/2003 | Aguilar | |
| 2003/0145957 | A1 * | 8/2003 | Domel et al. | 160/168.1 R |
| 2004/0154754 | A1 * | 8/2004 | Judkins | 160/84.01 |
| 2005/0022942 | A1 | 2/2005 | Heitel | |
| 2005/0056380 | A1 * | 3/2005 | Hsu | 160/84.04 |
| 2005/0087308 | A1 * | 4/2005 | Vaughan | 160/24 |
| 2005/0109468 | A1 | 5/2005 | Hsu | |
| 2005/0257900 | A1 * | 11/2005 | McCarty et al. | 160/168.1 R |
| 2005/0274466 | A1 * | 12/2005 | Hsu | 160/168.1 R |
| 2006/0086469 | A1 * | 4/2006 | Nien | 160/243 |
| 2006/0118251 | A1 * | 6/2006 | Miller | 160/133 |
| 2006/0191646 | A1 * | 8/2006 | Harper et al. | 160/84.05 |
| 2006/0243395 | A1 * | 11/2006 | Liang | 160/84.04 |
| 2007/0023151 | A1 | 2/2007 | Judkins | |
| 2007/0175594 | A1 * | 8/2007 | Jelic | 160/84.01 |
| 2007/0209765 | A1 * | 9/2007 | Lin | 160/84.04 |
| 2007/0277938 | A1 * | 12/2007 | Crider | 160/121.1 |
| 2008/0023153 | A1 * | 1/2008 | Rossato et al. | 160/84.04 |
| 2008/0035279 | A1 | 2/2008 | Gardner et al. | |
| 2008/0078511 | A1 * | 4/2008 | McCarty et al. | 160/168.1 R |
| 2008/0216966 | A1 | 9/2008 | Ben-David | |
| 2008/0264573 | A1 * | 10/2008 | Beck et al. | 160/95 |
| 2009/0014133 | A1 * | 1/2009 | Lin | 160/181 |

* cited by examiner

MAGNETIC CORDLESS SHADE

BACKGROUND OF THE INVENTION

1. Field of the Invention

The present invention relates to window shades, and more specifically to an economical magnetic cordless shade for fast deployment whenever shade or cover is desired.

2. Description of the Related

In most situations where danger is from outside, the windows of a building pose the biggest threat to the occupants. Unless reinforced, the windows can easily be breached, and they provide a view of the occupants therein for potential enemies outside. Since most windows include a blind for shade or privacy purposes, it is common practice to cover the windows in emergency or dangerous situations. The blind, typically Venetian or roll-up blinds, provides a barrier from potentially harmful debris should the window break or shatter as well as obscure the view. Rapid deployment of the blind is advantageous in these situations, but due to the construction of a Venetian blind, the catch mechanism often hinders fast release of the slats. With respect to a roll-up blind, the reeling mechanism is prone to wear so that reeling and un-reeling becomes unreliable. In many facilities, such as schools, office buildings, and the like, lock down procedures typically call for windows, and particularly windows disposed in classroom or office doors, to be covered as quickly as possible. Thus, it would be a benefit in the art to provide a window shade that can easily and reliably deploy in a rapid manner while minimizing costs for the same.

Thus, a magnetic cordless shade solving the aforementioned problems is desired.

SUMMARY OF THE INVENTION

The magnetic cordless shade includes a header defined by a substantially elongated U-shaped channel. The top of the header includes attachment areas for attaching the header to a window frame. A pleated blind has one end attached to the web of the header channel, and when folded, the blind is housed inside the channel. The other end of the pleated blind is attached to a footer. A magnetic latching assembly is disposed between the header and the footer to keep the blind in a folded condition. Pulling a pull cord disposed on the footer releases the magnetic latching mechanism to thereby rapidly unfold the blind.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
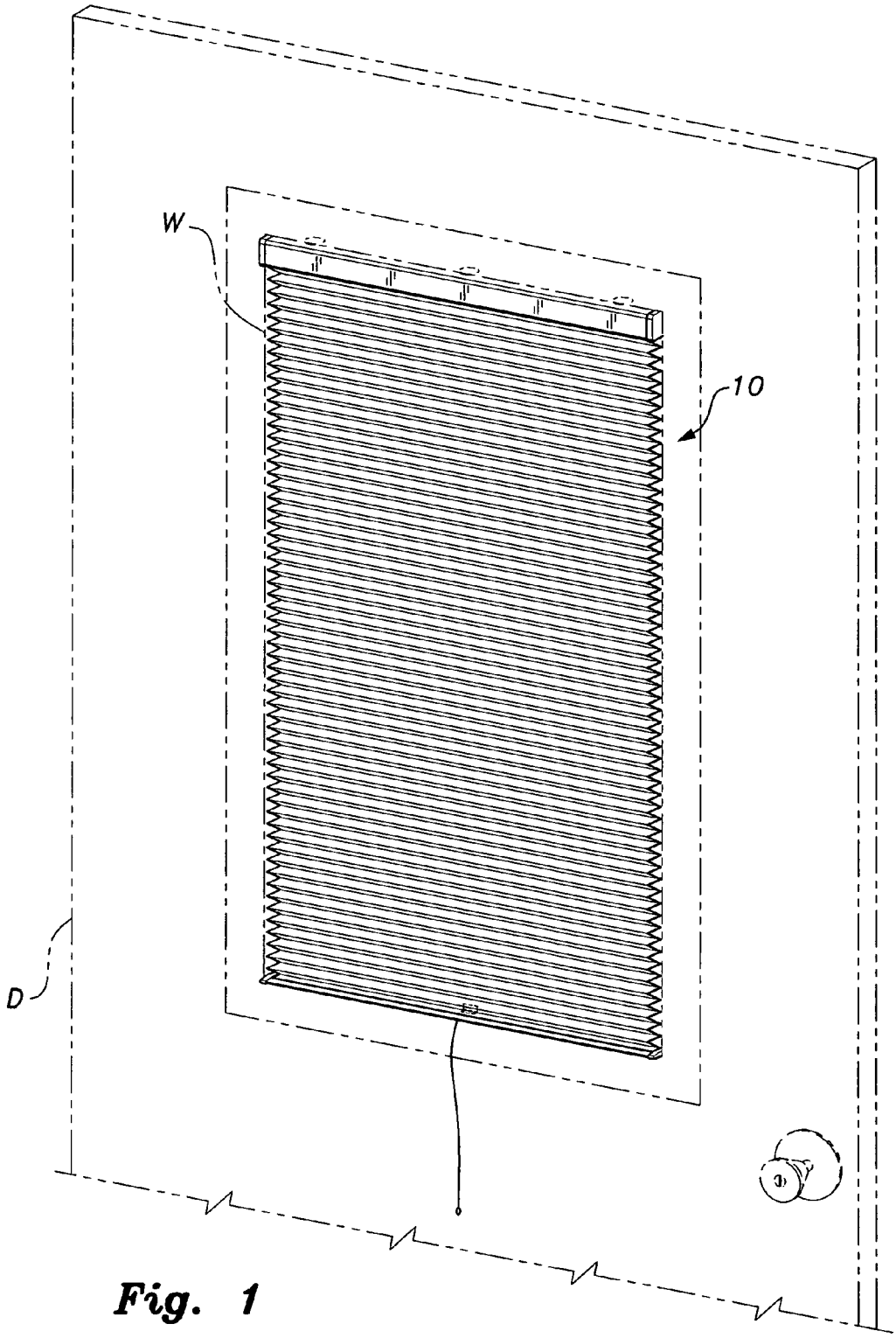
FIG. 1 is an environmental, perspective view of a magnetic cordless shade according to the present invention.
Figure 2:
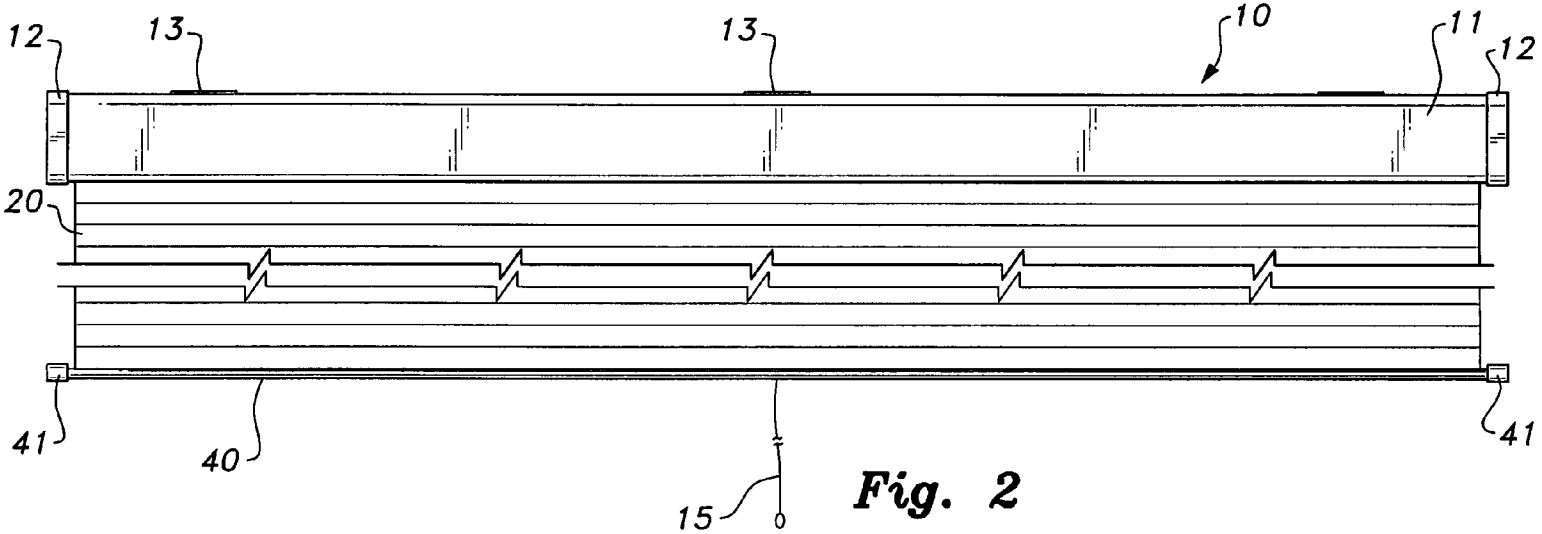
FIG. 2 is a partial front view of the magnetic cordless shade according to the present invention.
Figure 3:
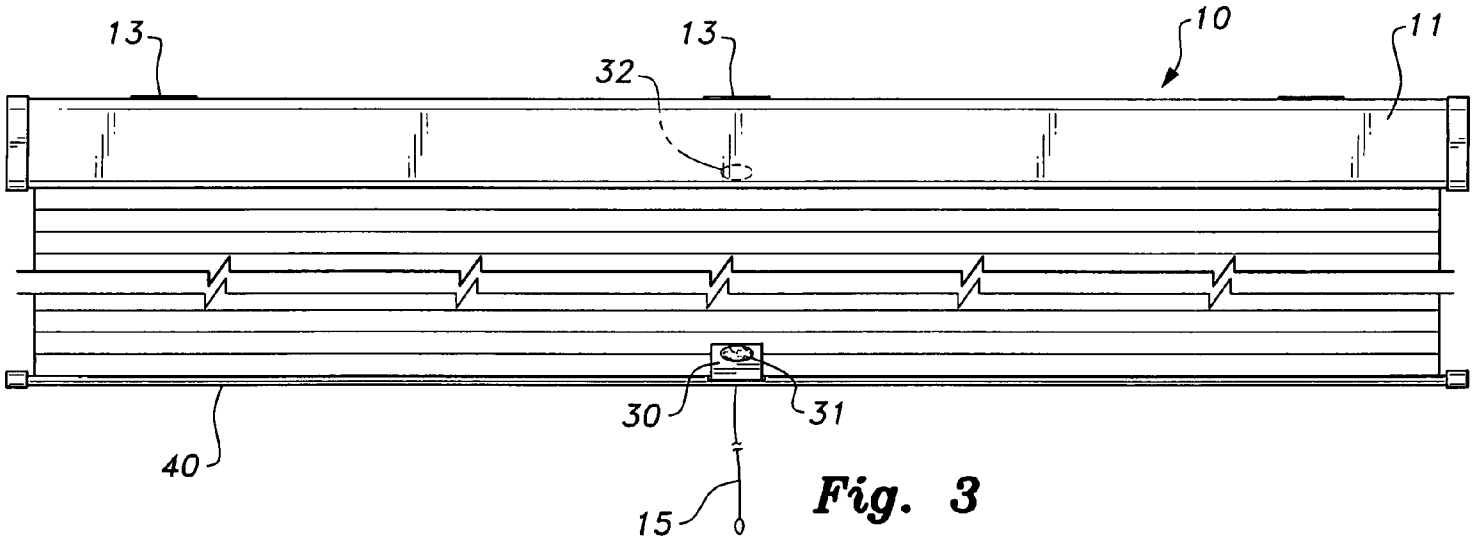
FIG. 3 is a partial rear view of the magnetic cordless shade according to the present invention.

The present invention relates to a rapidly deployable magnetic cordless shade, generally referred to by reference number 10, which is simple in construction and cost effective. As shown in FIGS. 1-4, the magnetic cordless shade 10 includes a header or head rail 11, a footer or foot rail 40 and a blind 20 disposed between the head and foot rails 11, 40. The head rail 11 is an elongate, U-shaped channel formed from a web and two substantially parallel flanges extending from opposite edges of the web, the channel having an interior defining a housing space for the blind 20. The head rail 11 is adapted to be mounted to the top of a window frame. To facilitate the mounting, the head rail 11 includes attachment areas 13 where fasteners or adhesives may be used to attach the head rail 11 to the window frame. Alternatively, one of the sides of the head rail 11 may include attachment areas to facilitate mounting the head rail 11 above a window niche. Another alternative may employ hanging brackets for the head rail 11. The distal ends of the head rail 11 may be covered by end caps 12.

The blind 20 is preferably a folded stack of fabric, or pleated fabric, that will stow inside the housing area of the head rail 11 when in a folded condition. The fabric may be made from paper, textile, vinyl or composites so long as it is durable and provides shade. An anchoring upper vane or slat 21 is attached to the upper end of the blind 20. The upper anchoring slat 21, in turn, is fixed to the web 17 of the header rail 11 by fasteners or adhesives. The lower end of the blind 20 is attached to another anchoring vane or slat 22.

The footer or foot rail 40 is an elongate channel dimensioned to slidably fit over the lower anchoring slat 22. The two anchoring slats 21, 22 on the respective rails provide a stable connection so that the blind 20 may easily unfold or fold. A pull cord 15 is operatively disposed on the foot rail 40. The foot rail 40 may also include end caps 41 to cover the distal ends.

Figure 4:
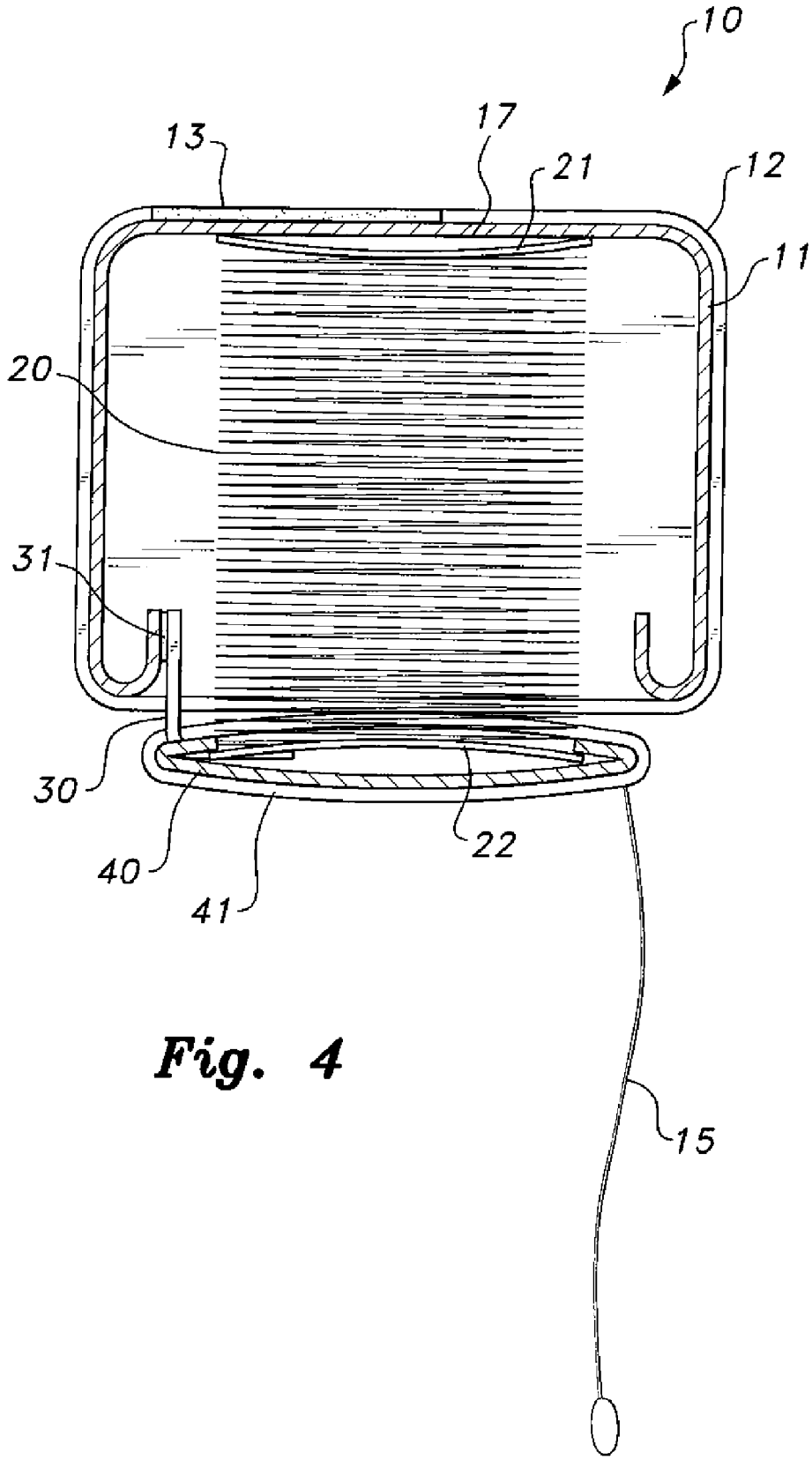
FIG. 4 is a side view in section of the magnetic cordless shade according to the present invention, the shade being retracted into the header channel.
Figure 5A:
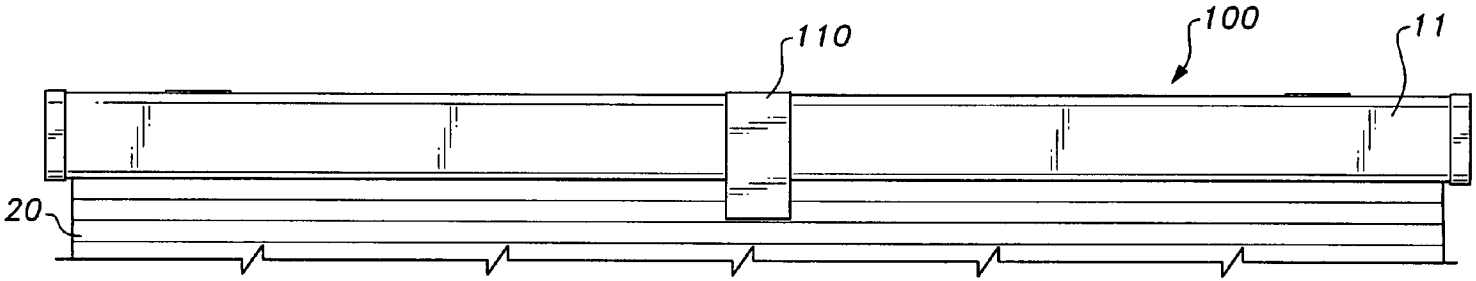
FIG. 5A is a rear view of an alternative embodiment of a magnetic cordless shade according to the present invention.
Figure 5B:
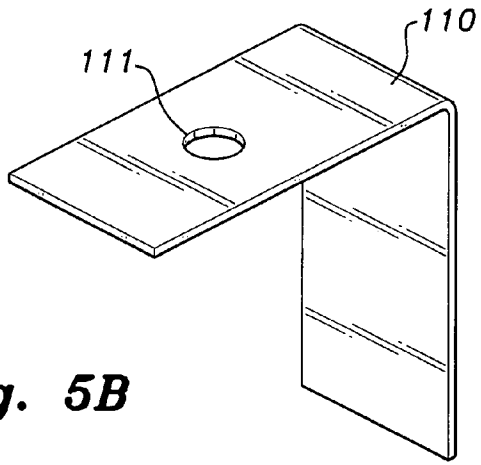
FIG. 5B is a perspective view of a metal latch locking bracket of the alternative embodiment of the magnetic cordless shade shown in FIG. 5A.

To keep the blind 20 in a stowed or folded condition, the magnetic cordless shade 10 includes a magnetic latching assembly disposed between, or having mating components attached to or formed by, the header and the footer 11, 40. The magnetic latching assembly includes a magnetic latch 30 disposed on the foot rail 40. The magnetic latch 30 may be a folded bracket with a magnet 31 mounted or bonded thereon. The magnet 31 is preferably a neodymium magnet. If the head rail 11 is made from a ferromagnetic material, such as steel, then the magnetic latch 30 may simply latch to the interior of head rail 11, as shown in FIG. 4. For other instances, such as a head rail 11 made from aluminum or plastic, the head rail 11 may include a magnetic locking latch 32, keeper, or catch mounted inside the head rail 11. The magnetic locking latch 32 is preferably a strip of ferromagnetic material or an oppositely polarized magnet. To ensure unobtrusive latching between the rails 11 and 40, the head rail 11 may include a slot through which the magnetic latch 30 may pass.

The following describes operation of the magnetic cordless shade 10. As shown in FIG. 4, the magnetic cordless shade 10 is assumed to be in a folded condition with the magnetic latch

30 locked onto the head rail 11. When it is desired to rapidly cover the window W, e.g., a window on a door D (shown in FIG. 1), the user pulls the pull cord 15 with enough force to release the magnetic latch 30 to allow the weight of the foot rail 40 and gravity assist with unfolding and extending or lowering the blind 20. Thus, the blind 20 is rapidly deployed with minimal or any hindrance. When shade or cover is no longer needed, the user lifts the foot rail 40 and folds the blind 20 back into the channel and secures the magnetic latch 30.

Figure 6A:
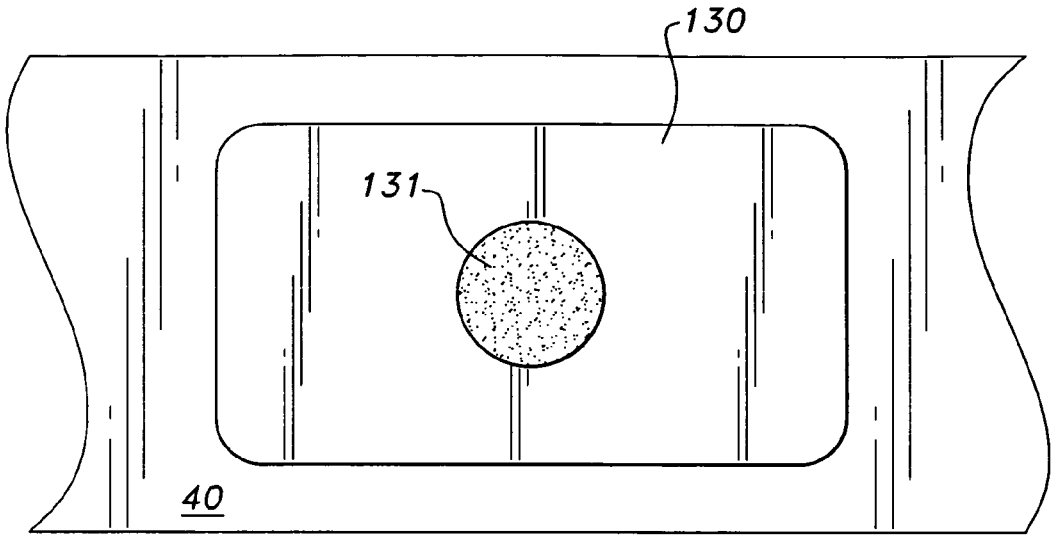
FIG. 6A is a front view of an alternative embodiment of a magnetic latch for a magnetic cordless shade according to the present invention.
Figure 6B:
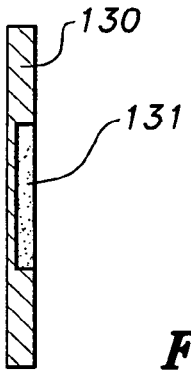
FIG. 6B is a side view in section of the alternative magnetic latch of FIG. 6A.

Referring to FIGS. 5A-6B, alternative magnetic latching assemblies for the magnetic cordless shade 10 are shown. For example, in FIGS. 5A and 5B, the magnetic cordless shade 100 includes a magnetic locking latch 110. The magnetic locking latch 110 may be a L-shaped bracket mounted to the exterior of the head rail 11 by a fastener inserted through fastener hole 111, the bracket being made from ferromagnetic material. In operation, the magnetic latch 30 latches onto the depending portion or downwardly extending leg of the bracket. Also, as shown in FIGS. 6A and 6B, the magnetic latch 130 may be a strip of material of any desired shape that is attached to the foot rail 40. A magnet 131 is embedded in the strip and functions similar to the above magnetic latch 30.

Thus, it can be seen that the magnetic cordless blind 10 is relatively simple in construction. In terms of costs, the magnetic cordless blind 10 is very cost effective compared to Venetian blinds due to the customization options offered by the cordless blind 10. The costs of a custom Venetian blind increase when the length is shorter than standard, due in part to the hardware associated therewith, i.e., the cords that pull or lower the slats and custom slats to accommodate the cords. In contrast, the magnetic cordless blind 10 does not include such hardware considerations for the custom dimensions.

It is to be understood that magnetic cordless blind 10 may encompass a variety of other alternatives. For example, the head rail 11 may include a similar strip as that of the magnetic latch 130 so long as the magnet is of opposite polarity. Moreover, the blind 20 may include a variety of colors and patterns. Furthermore, the magnetic cordless blind 10 may come in a variety colors, including indicia for advertising or personalization.

It is to be understood that the present invention is not limited to the embodiments described above, but encompasses any and all embodiments within the scope of the following claims.

I claim:

1. A window shade, consisting of:

a header adapted to be mounted to a window frame or niche, the header including an elongated U-shaped channel formed by a web and two substantially parallel opposing flanges extending from opposite sides of the web, the channel defusing a housing area for stowing the shade when retracted;

a footer disposed below the header, the footer having a pull cord;

a window shade, the shade defining a foldable blind being attached at its upper end to the header and at its lower end to the footer thereby extending between the header and the footer, the blind having a retracted position when the blind is folded within the channel and an extended position substantially covering the widow frame; and a magnetic latching assembly selectively attaching the header to the footer to keep the blind retracted within the channel, wherein pulling the pull cord releases the magnetic latching assembly to rapidly extend the blind.

* * * * *